US005874900A

United States Patent [19]

Panto

[11] Patent Number: 5,874,900

[45] Date of Patent: Feb. 23, 1999

[54] MONITORING SYSTEM AND METHOD FOR AN OVERHEAD POWER LINE PHASE SWITCH

[75] Inventor: Andrew S. Panto, Matthews, N.C.

[73] Assignee: Southern Electrical Equipment Company, Charlotte, N.C.

[21] Appl. No.: 650,131

[22] Filed: May 8, 1996

[51] Int. Cl.[6] ..... G08B 21/00

[52] U.S. Cl. ..... 340/644; 340/686; 200/48 A; 200/48 KB; 200/48 R; 200/49

[58] Field of Search ..... 340/644, 686; 200/48 A, 48 KB, 49, 48 R; 335/17

[56] References Cited

U.S. PATENT DOCUMENTS

| | | | |
|---|---|---|---|
| 2,462,342 | 2/1949 | Trogner | 200/48 KB |
| 3,226,499 | 12/1965 | Curtis et al. | 200/48 R |
| 3,243,534 | 3/1966 | Turner | 200/48 A |
| 3,255,332 | 6/1966 | Curtis et al. | 200/48 R |
| 3,382,330 | 5/1968 | Bernatt et al. | 200/48 A |
| 3,388,297 | 6/1968 | Curtis et al. | 361/61 |
| 3,409,815 | 11/1968 | Wright et al. | 320/134 |
| 3,530,263 | 9/1970 | Joyce | 200/48 FB |
| 3,647,996 | 3/1972 | Bernatt et al. | 200/48 R |
| 3,780,625 | 12/1973 | Weston et al. | 200/48 R |
| 4,095,061 | 6/1978 | Bridges | 200/48 KB |
| 4,110,579 | 8/1978 | Frink et al. | 218/12 |
| 4,357,505 | 11/1982 | Bridges | 200/48 KB |
| 5,534,858 | 7/1996 | Tinkham | 340/686 |
| 5,560,474 | 10/1996 | Thomas et al. | 200/48 A |

*Primary Examiner*—Jeffrey A. Hofsass
*Assistant Examiner*—Sihong Huang
*Attorney, Agent, or Firm*—Nixon & Vanderhye PC

[57] ABSTRACT

In an overhead power line switch, critical switch adjustment dimensions, switch position, switch status and other switch parameters are sensed by a plurality of particularly placed sensors, allowing determination as to whether the switch has operated correctly at critical points of the switch. The sensors also provide critical maintenance indication as to the operational status of the switch. In a preferred arrangement, the sensors are positioned to sense at least one of whether the contact blade is in a toggled closed position or a switch-open position, whether the contact blade is aligned with the clip assembly, the contact blade depth in the clip assembly, etc. The monitoring system is preferably provided with a remote terminal unit delivering sensor data to a remote operating facility.

30 Claims, 6 Drawing Sheets

MONITORING SYSTEM AND METHOD FOR AN OVERHEAD POWER LINE PHASE SWITCH

TECHNICAL FIELD

The present invention relates to overhead power line phases and, more particularly, to a monitoring system for an overhead power line phase switch for monitoring switch position and operation and indicating the same to a local or remote operator.

BACKGROUND

Overhead power lines typically operate in a three-phase system, with each phase disposed on the pole in vertically spaced relation to one another. Each phase carries a number of ways. This arrangement requires group-actuated switches such that the corresponding ways in the phases can be simultaneously opened or closed. Typically, each switch includes a contact blade that extends from an electrical line mounted on an insulator carried by support structure on the pole for disconnection/connection with a contact member or clip assembly centrally located on the support structure in electrical contact with one or more other ways. The movable contact blades are group-operated or ganged together so that the switches of the three phases may be simultaneously disconnected or connected. Commonly, vertical shafts carried by the support structure on the pole interconnect the movable contact blades such that by rotating the vertical shafts, the blades may be moved between switch-open and toggle or overcenter closed positions. An example of one such arrangement is disclosed in commonly owned U.S. patent application Ser. No. 08/290,618 filed Aug. 15, 1994, the disclosure of which is hereby incorporated by reference.

Utilities are rapidly pursuing the automation of phase switches. Typically, such automation has included the installation of motor operators, which serve to provide local and remote operation of phase switches, remote terminal units (RTUs), which provide a communication device to a remote operating facility, radios and the like. Current motor operators may be provided with auxiliary switch contacts for remote indication of contact blade position, but the current systems only serve to actuate the switches as opposed to increase switch reliability or provide information that guarantees that the switches have moved correctly. As a result, utilities often dispatch line workers to a switch site to watch a switch while it is operated remotely to ensure correct operation. Similarly, utilities often check switches after they have been operated remotely to confirm proper operating positions (either fully opened or closed). Such "manual" monitoring is not cost effective.

DISCLOSURE OF THE INVENTION

In accordance with the present invention, an apparatus and method are provided for monitoring an overhead power line phase switch and for indicating switch status locally and/or remotely.

The monitoring system and method according to the present invention provide information on critical switch adjustment dimensions, position or status (e.g., MONORUPTR® pick up arm position, fluid level, arc/switch temperatures, etc.). With this information, it can be determined whether the switch has operated correctly at the critical points of the switch as opposed to merely indicating that the switch control pipe has rotated. Additionally, the system and method according to the invention can provide critical maintenance indication as to the operational status of the switch. Still further, the system and method of the invention facilitate installation of switches by providing local status information and also increase safety and reliability as well as decrease repair expenses by allowing only properly functioning switches to operate through disabling of the motor operator in accordance with data obtained from the monitoring system.

These and other objects and advantages of the invention are achieved by providing an apparatus for monitoring an overhead power line phase switch including at least one contact blade engageable with a clip assembly to carry electric current. The contact blade is remotely moved along an operating path to thereby remotely engage and disengage with the clip assembly. The monitoring apparatus includes a contact blade position sensor disposed in the operating path of the contact blade. The contact blade position sensor senses whether the contact blade is in a toggled overcenter closed or a switch-open position. An alignment sensor is disposed in cooperation with the contact blade and the clip assembly and senses whether the contact blade is aligned with the clip assembly. A contact blade depth sensor may also be provided disposed in cooperation with the clip assembly, which senses the contact blade depth in the clip assembly.

The contact blade position sensor preferably comprises a first sensor disposed in the vicinity of the clip assembly for sensing whether he contact blade is in the closed position and a second sensor disposed at an end of the contact blade opposite from the clip assembly for sensing whether the contact blade is in the switch-open position.

The alignment sensor and the contact blade depth sensor preferably comprise photoelectric sensors, which may be constructed from non-conductive fiber optic cables. A timer may be coupled to each of the photoelectric sensors for preventing false alarms caused by a temporary interruption of the photoelectric sensor indicating beams.

In one arrangement, an indicator panel is operatively connected to the contact blade position sensor, the alignment sensor and/or the contact blade depth sensor and outputs sensor data. The monitoring apparatus may further include a plurality of relays operatively connected to the contact blade position sensor, the alignment sensor and/or the contact blade depth sensor for delivering sensor data to the indicator panel.

The overhead power line phase switch may further comprise a motor operator control circuit for controlling movement of the contact blade. The motor operator control circuit communicates with the contact blade position sensor, the alignment sensor and/or the contact blade depth sensor such that when a malfunction is detected, the motor operator control circuit is disabled. The apparatus may further comprise a remote terminal unit (RTU) communicating with a remote operating station. The RTU receives sensor data from the contact blade position sensor, the alignment sensor and/or the contact blade depth sensor and delivers the sensor data to the remote operating station.

In accordance with another aspect of the invention, there is provided a phase switch including at least one contact blade movable along an operating path between a closed position and a switch-open position; at least one clip assembly adapted to receive the contact blade in the closed position; a contact blade position sensor disposed in the operating path of the contact blade for sensing whether the contact blade is in the closed position or the switch-open position; and an alignment sensor disposed in cooperation with the contact blade and the clip assembly for sensing whether the contact blade is aligned with the clip assembly. A contact blade depth sensor may also be provided disposed in cooperation with the clip assembly for sensing the contact blade depth in the clip assembly.

In accordance with still another aspect of the invention, there is provided a method of monitoring an overhead power line phase switch including at least one contact blade engageable with a clip assembly to carry electric current, the contact blade being remotely moved along an operating path to thereby remotely engage and disengage with the clip assembly. The method includes sensing whether the contact blade is in a closed position or a switch-open position; and sensing whether the contact blade is aligned with the clip assembly. The method may further include sensing the contact blade depth in the clip assembly.

BRIEF DESCRIPTION OF THE DRAWINGS

These and other aspects of the invention will be described in detail with reference to the accompanying drawings, in which.

BEST MODE FOR CARRYING OUT THE INVENTION

Figure 1:
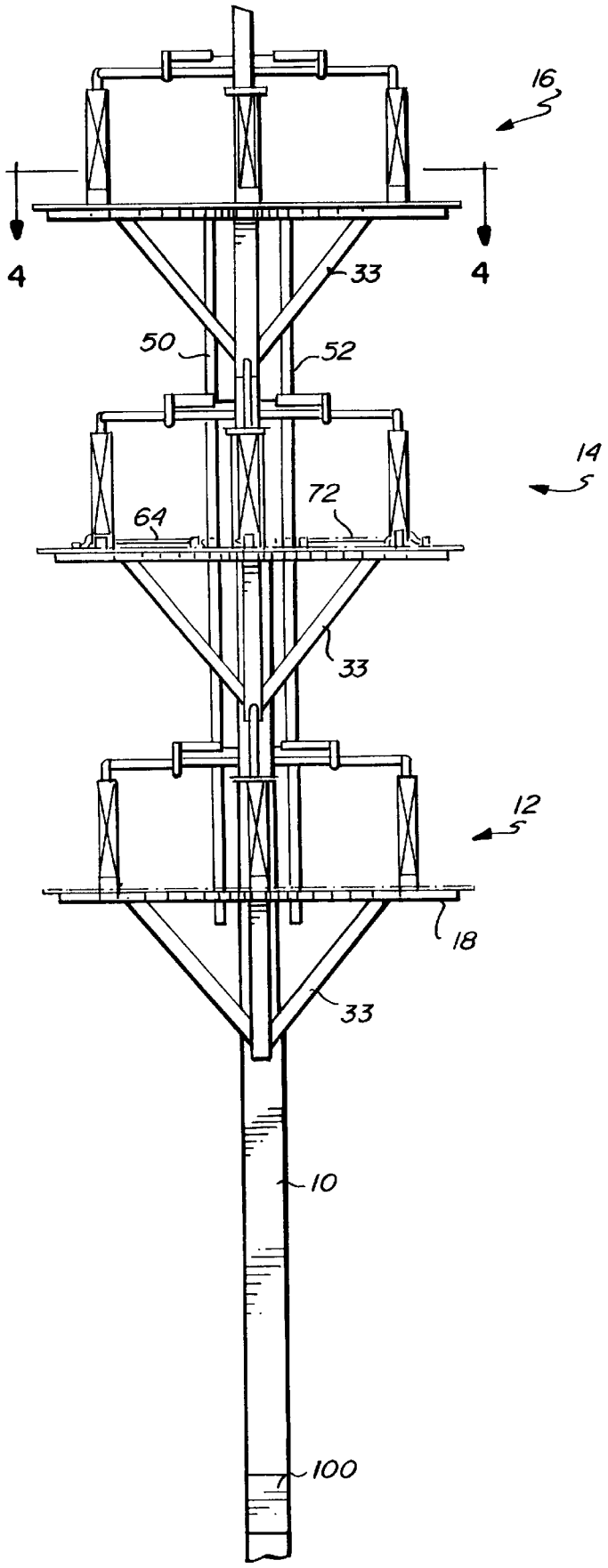
FIG. 1 is an elevational view of a three-phase power supply distribution system on an overhead pole.

Referring now to FIG. 1, there is illustrated a power line distribution pole 10 for carrying power transmission lines (not shown) in three phases at different elevations, respectively, for example, lower, intermediate and upper phases 12, 14 and 16, respectively. Each phase 12, 14, and 16 includes a support structure or frame for the power lines, switches, insulators and associated elements. For example, the support structure at each phase includes a platform comprised of a main support 20 (FIG. 3) projecting horizontally from the pole 10 having lateral support arms 22 and 24 as well as sides 26 and 28 connected between the ends of the lateral arms 22 and 24, respectively, and the distal end of the main support 20. Suitable cross-bracing is provided, for example, at 30 and 32. The platform is supported by various inclined bracing 33 connected to the pole and platform as illustrated in FIG. 1. It will be appreciated that the platforms may comprise any suitable shape with various types of support structure, it being sufficient for present purposes to indicate that the platforms support each phase of the switch assemblies at the various elevations, as well as the associated equipment.

Figure 2:
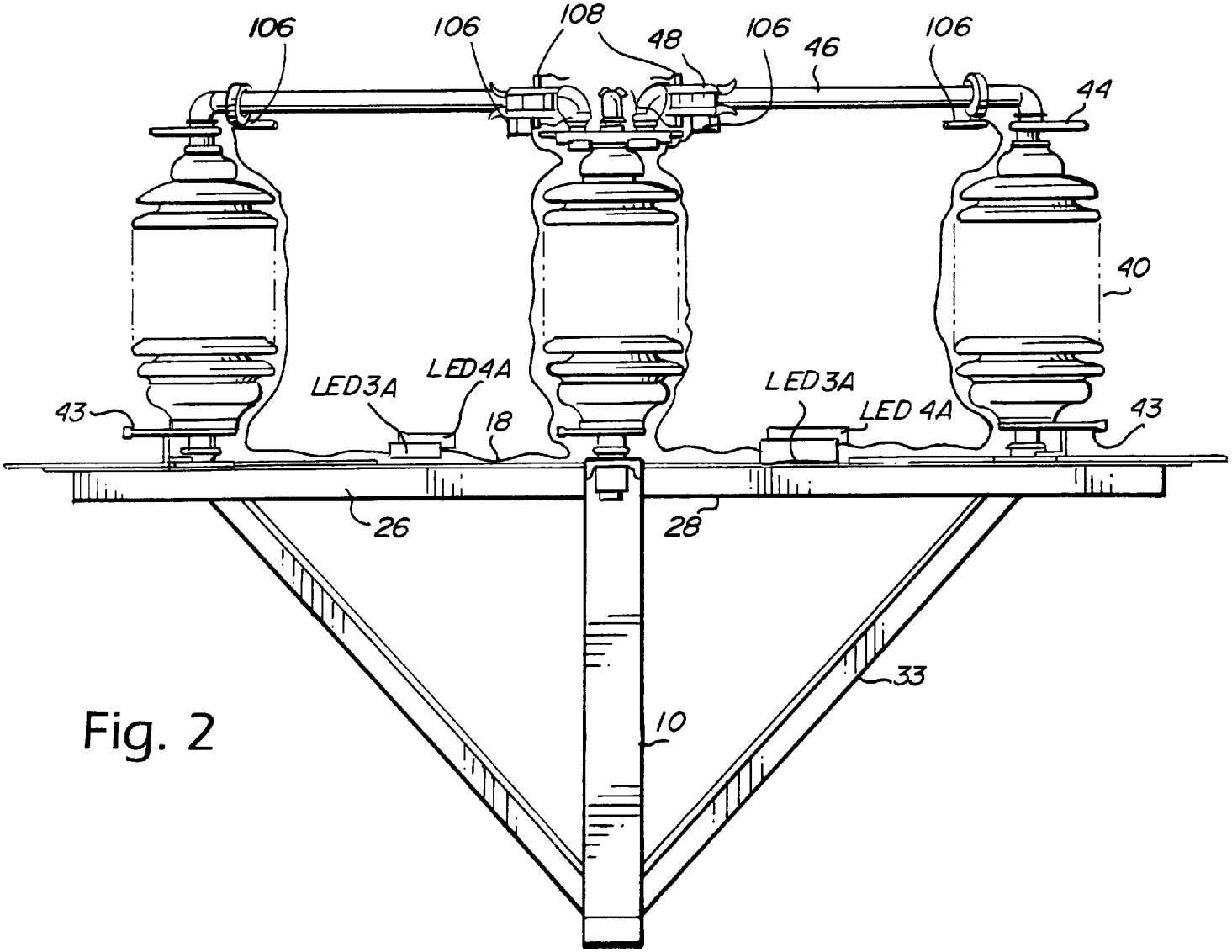
FIG. 2 is an enlarged elevational view of one of the phases.
Figure 3:
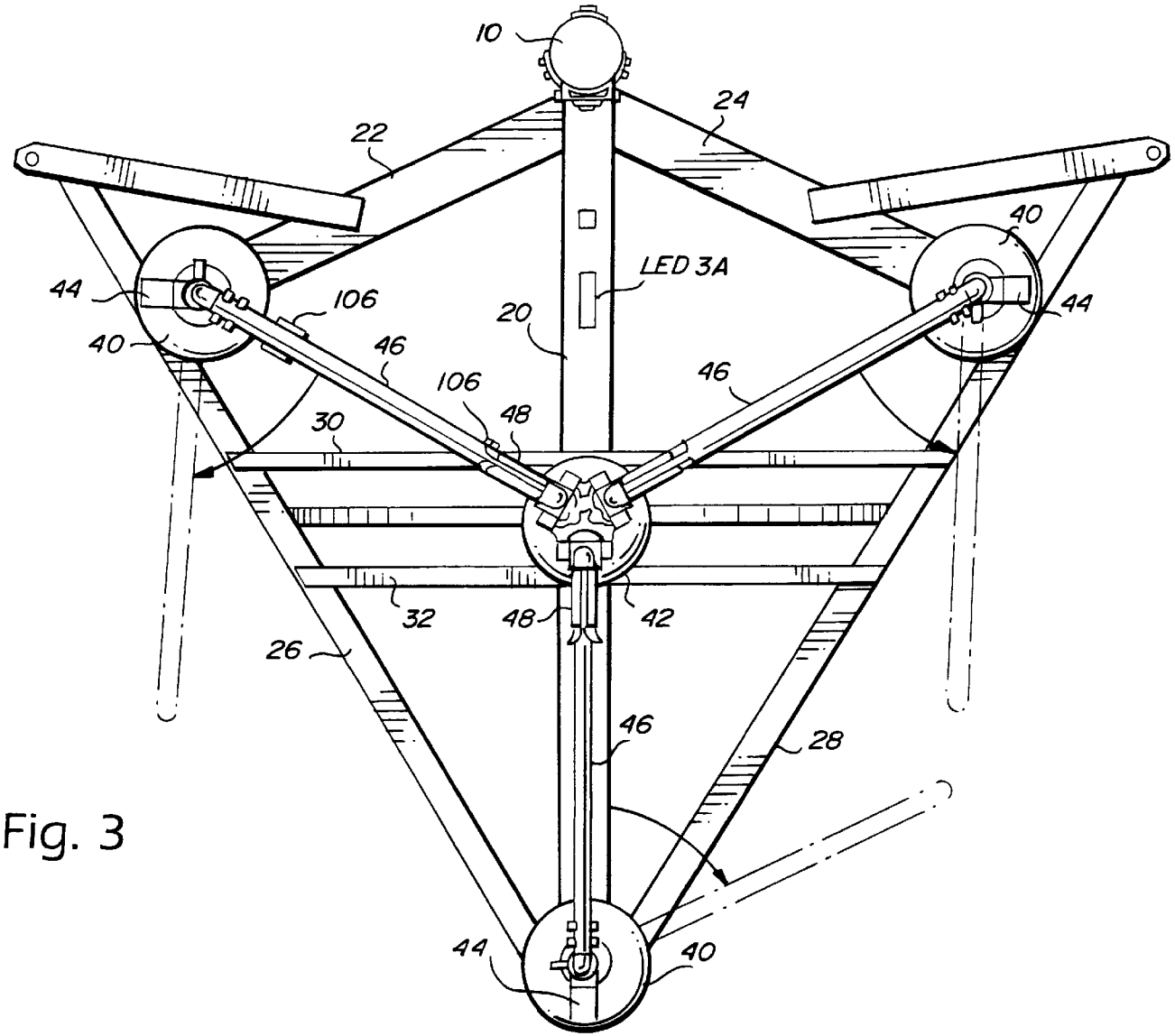
FIG. 3 is a plan view of the upper phase.

Referring now to FIGS. 2 and 3, the uppermost phase is illustrated, it being understood that the other phases insofar as elements corresponding to those illustrations of FIGS. 2 and 3 are concerned are identical thereto. In phase 16, the platform supports insulators 40, in this instance, in a triangular configuration about a center insulator 42, each insulator 40 being carried on a lever 43 rotatably mounted on the platform 18. The upper end of each insulator 40 includes an electrical terminal pad 44 for connection with a power line and a movable switch contact blade 46 extending between the terminal pad 44 and a central clip assembly 48 carried by the central insulator 42. Thus, each of the contact blades of each phase connects with an electrical terminal pad 44 supported by an insulator and with a central connection including the clip assembly 48 whereby power may be distributed, for example, from one line to both of the other lines when connected. As best illustrated in FIG. 3, the movable contact blades are thus pivotally carried on the levers 43 over an operating path OP for movement between toggled overcenter closed positions as illustrated by the solid lines and switch-open positions illustrated by the dashed lines.

Figure 4:
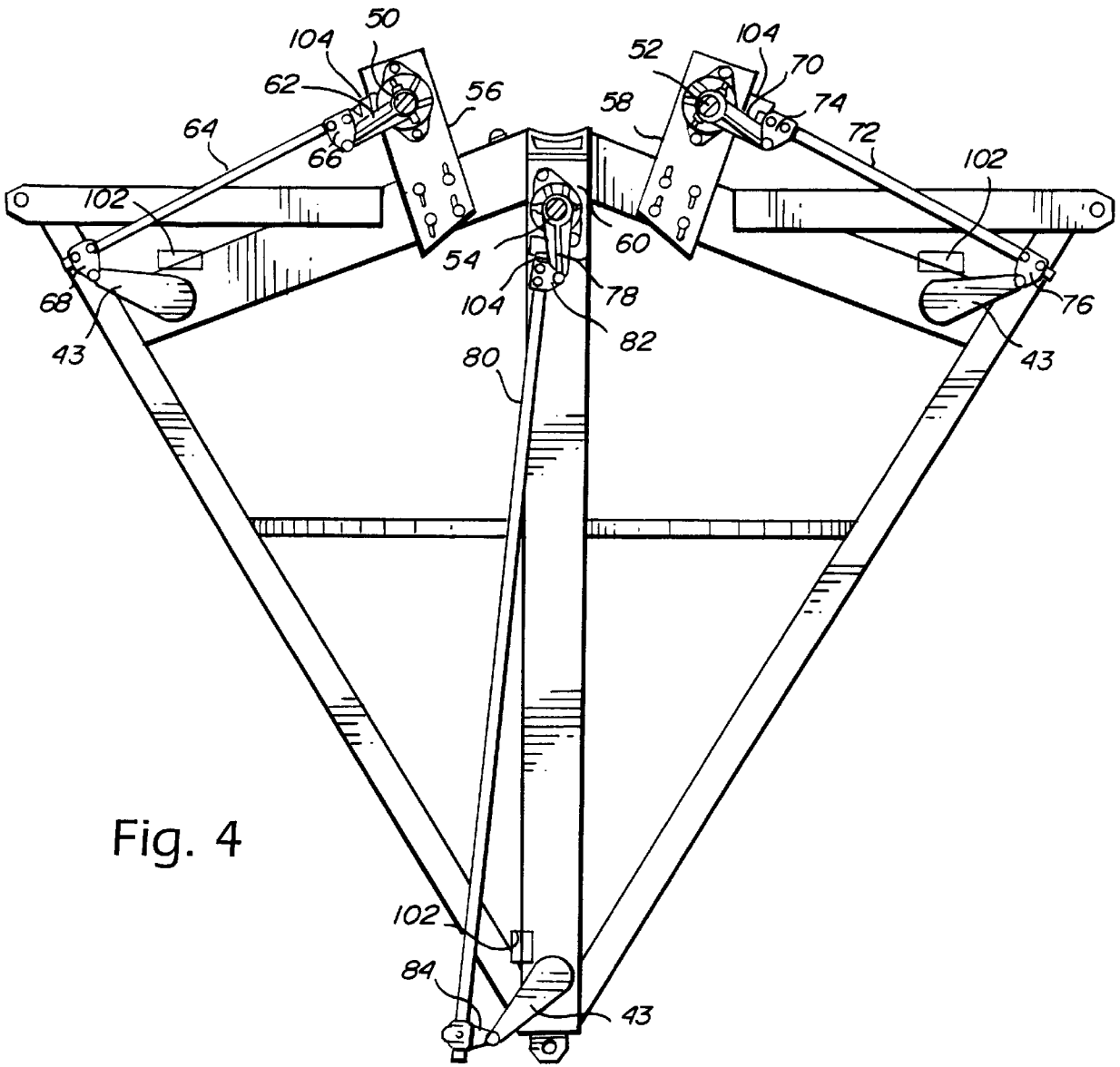
FIG. 4 is a cross-sectional view taken generally along line 4—4 in FIG. 1.

Referring to FIGS. 1 and 4, there is provided on the support structures associated with each phase 12, 14 and 16, three vertically extending shafts 50, 52 and 54. The shafts 50 and 52 are supported for rotation by outboard bearing plate assemblies 56 and 58, and the central shaft 54 is supported by an outboard bearing plate assembly 60. At each elevation, each shaft 50, 52 and 54 is connected to a crank pivotally connected to a lever arm which, in turn, is pivotally connected to the associated lever 43 carrying the insulators and the movable contact blades. For example, at each phase, a crank 62 is coupled to the vertical shaft 50 and pivotally connected to a lever arm 64 by way of a fitting 66. The opposite end of the lever arm 64 is pivotally connected by way of a similar fitting 68 to the lever 43. It will be appreciated from a review of FIG. 4 that a straight line drawn through the axis of the vertical shaft 50 and the pivotal connection between the fitting 68 and the lever 43 is offset from the pivotal connection between the lever 43 and the crank 62. The crank rotation as described hereinafter is such that the pivotal connection between the fitting 66 and the crank 62 must pass over center to rotate the insulator and corresponding contact blade.

The lever and crank assembly on the right hand side of FIG. 4 is similar to that described for the left side. That is, the vertical shaft 52 mounts a crank 70 pivotally coupled to a lever arm 72 by way of a fitting 74, the opposite end of the lever arm 72 being pivotally coupled by a fitting 76 to a lever 43. In the closed position of the corresponding contact blade, a straight line through the axis of the vertical shaft 52 and the pivotal connection between the lever 43 and the fitting 76 does not pass through the pivotal connection between the fitting 74 and the crank 70. Thus, in the toggled closed position, the crank lever assembly lies over center.

Also as illustrated in FIG. 4, a similar arrangement is illustrated with respect to the third insulator. For example, the crank 78 connected to the vertical shaft 54 is pivotally connected to the lever arm 80 by way of a fitting 82, the opposite end of the lever arm 80 being pivotally connected to the lever 43 by a fitting 84. As in the other crank lever assemblies, the pivotal axis between the crank 78 and the fitting 82 lies to one side of a straight line passing through the axis of the shaft 54 and the pivotal connection between the fitting 84 and the lever 43. Thus, it will be appreciated that rotation of shafts 50 and 54 in a clockwise direction and shaft 52 in a counterclockwise direction rotates the corresponding insulators and switch contact blades in corresponding directions, respectively, as illustrated in FIG. 3.

Referring back to FIG. 1, there is illustrated an electrical control panel 100 including a motor operator MO disposed adjacent the base of the pole 10 and electrically coupled through various switches and by various electrical wiring for driving the above-described lever and crank assemblies. By closing one or more of the switches in the control panel, the linear actuators may be selectively actuated to move the contact blades to the switch-open and the closed positions.

Figure 5:
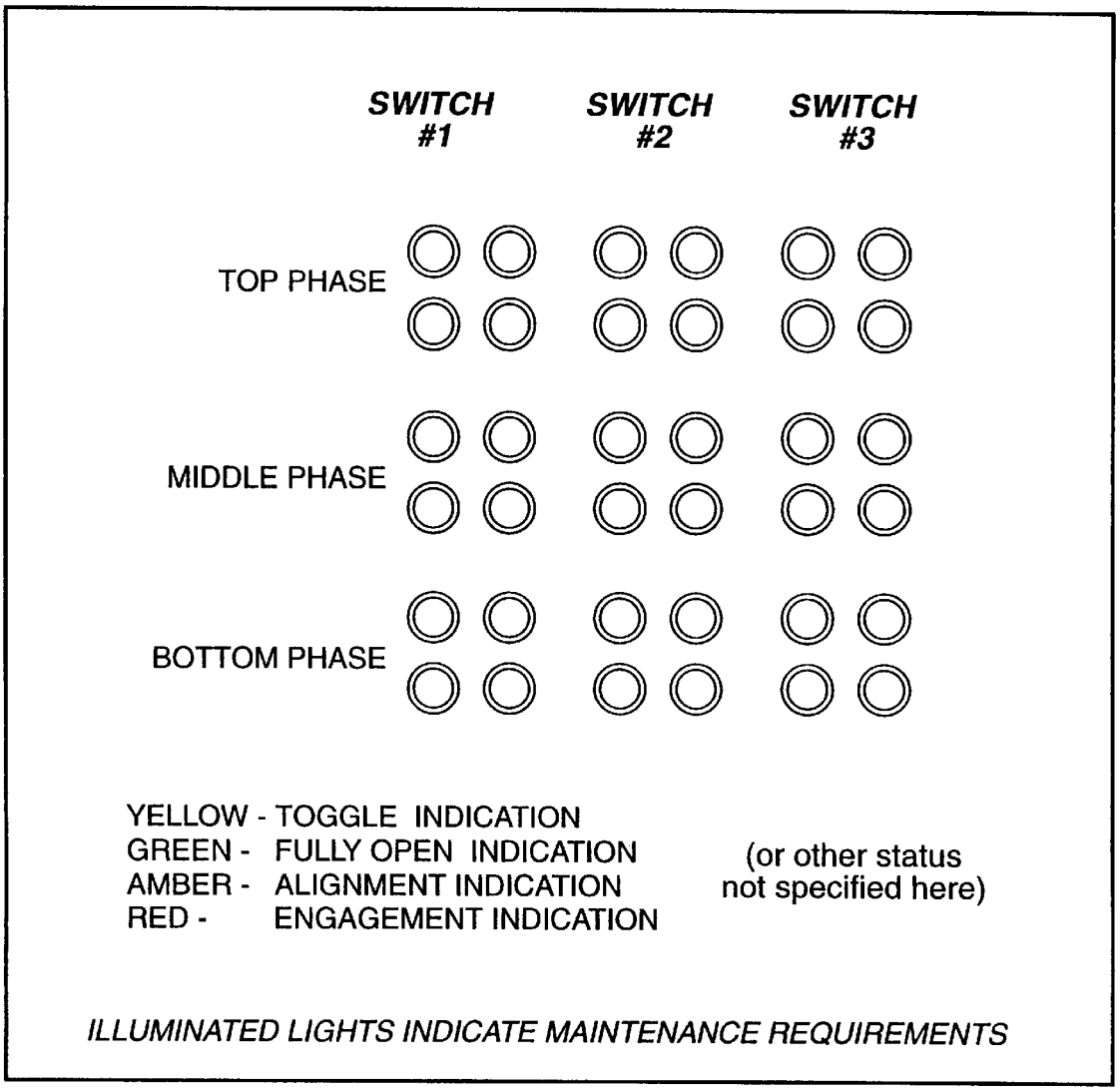
FIG. 5 illustrates an exemplary indicating panel according to the invention.

Referring to FIG. 5, the monitoring system according to the invention includes an indicating panel preferably disposed in the electrical control panel 100 at the base of the pole. The indicating panel includes local indicating lights (LEDs) as well as the relays and timers of the monitoring system. The LEDs turn on as problems are detected and indicate the type of problem or misadjustment, the particular switch (way) exhibiting the problem, the particular phase exhibiting the problem, etc. In the example illustrated, the indicating panel is designed for a SEECO 69 KV, 1200 AMP, 3-way phase over phase switch. Of course, different configurations could be provided as appropriate for the particular switch.

A monitoring system including a plurality of sensors particularly located on the phase switch provides information on critical switch adjustment dimensions, switch position, switch status and the like. The monitoring system will now be described with reference to FIGS. 2, 4 and 6.

Figure 6:
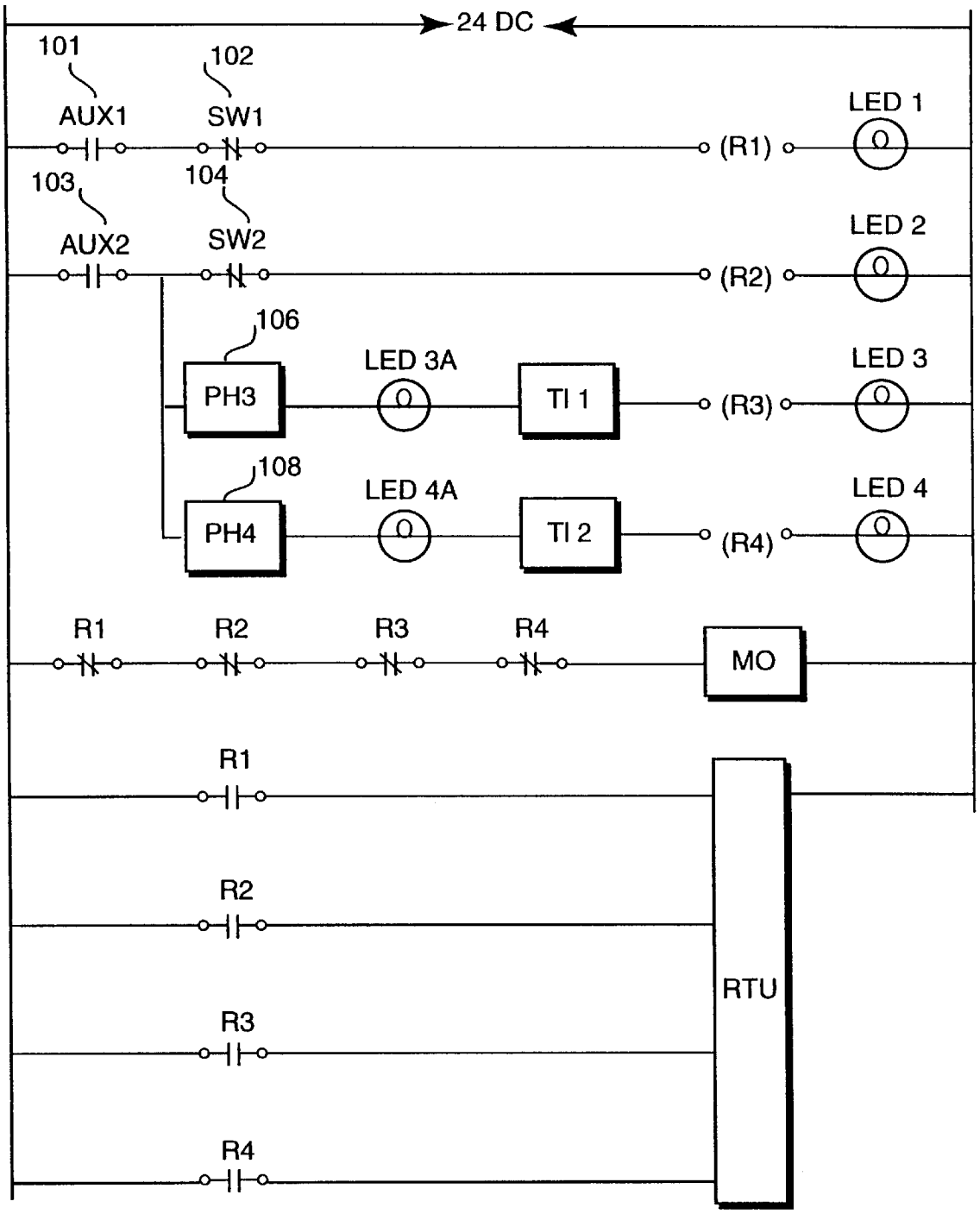
FIG. 6 illustrates a logic circuit of an exemplary phase.

As shown in FIG. 6, the monitoring system is powered with a 24 V DC power source. An open limit switch 101 (AUX1 in FIG. 6) is disposed in the control panel 100 at the base of the pole. The open limit switch 101 is actuated by an operator in accordance with desired system parameters, indicating that the particular switch should be in its switch-open position. A first contact blade position sensor 102 (FIG. 4) is disposed in the operating path OP of the contact blade 46 at a critical point of adjustment for which local and remote indication is needed. The first contact blade position sensor 102 senses whether the switch is correctly placed in the switch-open position in accordance with the desired system parameters as indicated by the open limit switch 101. In a preferred arrangement, an actuator peg (not shown) is attached to the lever 43, and the first contact blade position sensor 102 is a plunger type limit switch. When the contact blade is in its switch-open position, the actuator peg engages the limit switch. If the first contact blade position sensor 102 senses that the switch is not in its switch-open position, a relay R1 is energized and an LED (LED1) is illuminated on the indicating panel.

A closed limit switch 103 (AUX2) is also provided in the control panel 100 and is actuated by an operator in accordance with desired system parameters, indicating that the switch should be in its toggled closed position. A second contact blade position sensor 104 senses whether the switch is correctly placed in the toggled closed position in accordance with the desired system parameters as indicated by the closed limit switch 103. The second contact blade position sensor 104 is preferably configured in a manner similar to the first contact blade position sensor 102. If the second contact blade position sensor 104 senses that the switch is not in its toggled closed position, a relay R2 is energized and an LED (LED2) is illuminated on the indicating panel.

An alignment sensor 106 (PH3) is disposed in cooperation with the contact blade 46 and the clip assembly 48 and senses whether the contact blade 46 is directly in line with the clip assembly 48 both horizontally and vertically. The alignment sensor 106 preferably comprises a photoelectric sensor including a non-conductive fiber optic cable, a timer, a relay and two indicating lights, one at the base of the pole and the other mounted to the switch frame of the location being sensed. In a preferred arrangement, the emitter is disposed opposite the clip assembly end of the contact blade 46 and emits light that is received through a small hole in a sheet metal enclosure surrounding the photoelectric sensor receiver. The receiver consists of a lens disposed at an end of a fiber optic cable. The receiver, for example, is slidable in the sheet metal enclosure to adjust sensor sensitivity. The timer TI1 serves to prevent false alarms caused by a temporary interruption of the photoelectric sensor indicating beams. If the alignment sensor senses that the contact bar is misaligned, a relay R3 is energized, a first LED (LED3A) is illuminated to signal the operator at the frame level, and a second LED (LED3) is illuminated on the indicating panel.

A contact blade depth sensor 108 is disposed in cooperation with the clip assembly 48 and senses the contact blade depth in the clip assembly 48 within specified limits. Since this is at the high potential of the switch, a photoelectric sensor is utilized similar to the alignment sensor 106, including a non-conductive fiber optic cable, a timer, a relay and two indicating lights, one at the base of the pole and the other mounted to the switch frame at the location being sensed. In a preferred arrangement, the emitter and receiver of the sensor are disposed on opposite sides of the clip assembly 48. The contact blade 46 includes an aperture at an end thereof. The photoelectric elements are positioned to ensure that the blade depth falls within a predetermined depth range. In such an instance, the receiver receives emitted light through the contact blade aperture. The timer TI2 also serves to prevent false alarms. If the contact blade depth sensor 108 senses that the contact blade is disposed within the clip assembly outside of the allowable limits, a relay R4 is energized, a first LED (LED4A) is illuminated to signal the operation at the frame level, and a second LED (LED4) is illuminated on the indicating panel.

The relays R1, R2, R3 and R4 communicate with the motor operator control circuit MO such that if a relay is energized signifying an incorrect switch position, the motor operator control circuit MO is disabled. The relays are also coupled to a conventional remote terminal unit (RTU), enabling delivery of sensor data to a remote operating station.

The monitoring system and method according to the invention provide a positive indication of switch position. The sensors guarantee the position of the switch at multiple points and at the high potential of the switch. These high potential points of the switch are the most critical since they are what is used to carry the electrical current. The conventional indication of the switch control pipe location does not guarantee the movement of the high potential parts of a switch. The tolerances at each of these points that indicate an alarm situation can be adjusted as specified by the switch manufacturer.

The monitoring system also reduces maintenance costs by reducing regularly scheduled maintenance. Remote and local indication will be provided when the switch falls out the manufacturer's specified tolerance. Upon indication, a crew can be sent to fix the one item indicated as being out of adjustment. Time will also be saved in diagnostics by indicating the switch problem and location of the particular switch way and phase.

The indicating panel lights are configured to shut off as each component of the switch is correctly installed and adjusted. When all lights are off, the installation crew will know that the switch has been installed correctly. Lights will also be provided at each phase of the switch so as to eliminate any need for communication to the bottom of the pole while making the adjustments. The line worker may simply look down and adjust the switch until the lights shut off. The system guarantees that all the critical sensed parts of the switch are installed and adjusted correctly.

Moreover, the system enables operators to have the opportunity to make certain all the local switch indicating lights are off, providing the assurance that the switch is safe to operate. This helps to ensure the safety of the line worker when a switch is being operated manually. For remote operation, the indication can be tied to the motor control circuit, disabling the motor when a part of the switch is out of adjustment.

Switch reliability is increased due to more accurate initial installations of switch equipment. Reliability is also increased since any required maintenance needed on the switch can be performed immediately upon indication of a problem as opposed to waiting until the problem is discovered while the switch is being operated at a critical time. Still further, repair costs will be reduced since the switch will not be operated in conditions where it requires maintenance. Damages caused by operating these switches requiring maintenance will be virtually eliminated.

Of course, the invention is not meant to be limited to the particular sensors or the particular sensed parameters described above. Rather, those of ordinary skill in the art will contemplate alternative parameters and sensors for monitoring the phase switch according to manufacturer specifications. For example, an infrared sensor may be provided at the frame level for sensing the temperature of critical areas of the contact blades. In this regard, an analog or digital sensor may be used wherein if the contact blade critical area temperature exceeds a predetermined threshold temperature, an indicating signal can be sent via the RTU, or the motor operator control circuit can be disabled.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An apparatus for monitoring an overhead power line phase switch including at least one contact blade engageable with a contact assembly to carry electric current, the contact blade being remotely moved along an operating path to thereby remotely engage and disengage with the contact assembly, the apparatus comprising:

a contact blade position sensor disposed in the operating path of the contact blade, said contact blade position sensor sensing whether the contact blade is in a closed position or a switch-open position; and an alignment sensor disposed in cooperation with the contact blade and the contact assembly, said alignment sensor sensing whether the contact blade is aligned with the contact assembly.

2. A monitoring apparatus according to claim 1, wherein said contact blade position sensor comprises a first sensor disposed in the vicinity of the contact assembly, said first sensor sensing whether the contact blade is in the closed position, and a second sensor disposed adjacent an end of the contact blade opposite from the contact assembly, said second sensor sensing whether the contact blade is in the switch-open position.

3. A monitoring apparatus according to claim 1, further comprising a contact blade depth sensor disposed in cooperation with the contact assembly, said contact blade depth sensor sensing the contact blade depth in the contact assembly.

4. A monitoring apparatus according to claim 3, wherein said alignment sensor comprises a photoelectric sensor, and wherein said contact blade depth sensor comprises a photoelectric sensor.

5. A monitoring apparatus according to claim 4, wherein said photoelectric sensors comprise non-conductive fiber optic cables.

6. A monitoring apparatus according to claim 4, further comprising a timer coupled to each of said photoelectric sensors, said timers preventing false alarms caused by a temporary interruption of the photoelectric sensor indicating beams.

7. A monitoring apparatus according to claim 3, further comprising an indicator panel operatively connected to at least one of said contact blade position sensor, said alignment sensor, and said contact blade depth sensor, said indicator panel displaying sensor data.

8. A monitoring apparatus according to claim 7, further comprising a plurality of relays operatively connected to at least one of said contact blade position sensor, said alignment sensor, and said contact blade depth sensor, said relays delivering sensor data to said indicator panel.

9. A monitoring apparatus according to claim 3, wherein the overhead power line phase switch further comprises a motor operator control circuit for controlling movement of the contact blade, the motor operator control circuit communicating with at least one of said contact blade position sensor, said alignment sensor, and said contact blade depth sensor such that when a malfunction is detected, said motor operator control circuit is disabled.

10. A monitoring apparatus according to claim 3, further comprising a remote terminal unit (RTU) communicating with a remote operating station, said RTU communicating with at least one of said contact blade position sensor, said alignment sensor, and said contact blade depth sensor to deliver sensor data to the remote operating station.

11. A phase switch comprising:

at least one contact blade movable along an operating path between a closed position and a switch-open position;

at least one clip assembly adapted to receive said at least one contact blade in the closed position;

a contact blade position sensor disposed in the operating path of said contact blade, said contact blade position sensor sensing whether said contact blade is in the closed position or the switch-open position; and an alignment sensor disposed in cooperation with said contact blade and said clip assembly, said alignment sensor sensing whether said contact blade is aligned with said clip assembly.

12. A phase switch according to claim 11, wherein said contact blade position sensor comprises a first sensor disposed in the vicinity of said clip assembly, said first sensor sensing whether said contact blade is in the closed position, and a second sensor disposed adjacent an end of said contact blade opposite from said clip assembly, said second sensor sensing whether said contact blade is in the switch-open position.

13. A phase switch according to claim 11, further comprising a contact blade depth sensor disposed in cooperation with said clip assembly, said contact blade depth sensor sensing the contact blade depth in said clip assembly.

14. A phase switch according to claim 13, wherein said alignment sensor comprises a photoelectric sensor, and wherein said contact blade depth sensor comprises a photoelectric sensor.

15. A phase switch according to claim 14, wherein said photoelectric sensors comprise non-conductive fiber optic cables.

16. A phase switch according to claim 14, further comprising a timer coupled to each of said photoelectric sensors, said timers preventing false alarms caused by a temporary interruption of the photoelectric sensor indicating beams.

17. A phase switch according to claim 13, further comprising an indicator panel operatively connected to at least one of said contact blade position sensor, said alignment sensor, and said contact blade depth sensor, said indicator panel displaying sensor data.

18. A phase switch according to claim 17, further comprising a plurality of relays operatively connected to at least one of said contact blade position sensor, said alignment sensor, and said contact blade depth sensor, said relays delivering sensor data to said indicator panel.

19. A phase switch according to claim 13, further comprising a motor operator control circuit for controlling movement of the contact blade, the motor operator control circuit communicating with at least one of said contact blade position sensor, said alignment sensor, and said contact blade depth sensor such that when a malfunction is detected, said motor operator control circuit is disabled.

20. A phase switch according to claim 13, further comprising a remote terminal unit (RTU) communicating with a remote operating station, said RTU communicating with at least one of said contact blade position sensor, said alignment sensor, and said contact blade depth sensor to deliver sensor output to the remote operating station.

21. A method of monitoring an overhead power line phase switch including at least one contact blade engageable with a clip assembly to carry electric current, the contact blade being remotely moved along an operating path to thereby remotely engage and disengage with the clip assembly, the method comprising:

(a) sensing whether the contact blade is in a closed position or a switch-open position; and (b) sensing whether the contact blade is aligned with the clip assembly.

22. The method according to claim 21, further comprising prior to step (a) the step of manually designating whether the contact blade should be the closed position or the switch-open position.

23. The method according to claim 21, wherein if it is sensed in step (b) that the contact blade is not aligned with the clip assembly, the method further comprises (c) illuminating at least one indicator lamp.

24. The method according to claim 23, wherein step (c) is practiced by illuminating a first indicator lamp at a frame level and by illuminating a second indicator lamp at a pole base.

25. The method according to claim 21, comprising the further step of (d) sensing the contact blade depth in the clip assembly.

26. The method according to claim 25, wherein if it is sensed in step (d) that the contact blade depth in the clip assembly is outside of predetermined allowable limits, the method comprises (e) illuminating at least one indicator lamp.

27. The method according to claim 26, wherein step (e) is practiced by illuminating a first indicator lamp at a frame level and by illuminating a second indicator lamp at a pole base.

28. A method according to claim 25, wherein if it is sensed in any of steps (a), (b) and (d) that the contact blade is incorrectly positioned, the method comprises the step of disabling a motor operator control circuit.

29. A method according to claim 25, further comprising remotely delivering sensor data with an RTU.

30. A method according to claim 25, further comprising delivering sensor data to an indicating panel.

* * * * *